US008070626B2

(12) United States Patent
Morgan

(10) Patent No.: US 8,070,626 B2
(45) Date of Patent: Dec. 6, 2011

(54) GOLF BALL WITH A TRANSLUCENT LAYER COMPRISING COMPOSITE MATERIAL

(75) Inventor: William E. Morgan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 184 days.

(21) Appl. No.: 12/143,879

(22) Filed: Jun. 23, 2008

(65) Prior Publication Data

US 2008/0254913 A1 Oct. 16, 2008

Related U.S. Application Data

(63) Continuation-in-part of application No. 11/707,493, filed on Feb. 16, 2007, now Pat. No. 7,722,483.

(51) Int. Cl.
*A63B 37/06* (2006.01)

(52) U.S. Cl. ..... 473/378

(58) Field of Classification Search ..... 473/378
See application file for complete search history.

(56) References Cited

U.S. PATENT DOCUMENTS

| | | | |
|---|---|---|---|
| 2,809,954 | A | 10/1957 | Kazenas |
| 2,851,424 | A | 9/1958 | Switzer et al. |
| 2,938,873 | A | 5/1960 | Kazenas |
| 3,253,146 | A | 5/1966 | de Vries |
| 3,412,036 | A | 11/1968 | McIntosh |
| D228,394 | S | 9/1973 | Martin et al. |
| 3,989,568 | A | 11/1976 | Isaac |
| 4,123,061 | A | 10/1978 | Dusbiber |
| 4,128,600 | A | 12/1978 | Skinner et al. |
| 4,317,933 | A | 3/1982 | Parker |
| 4,342,793 | A | 8/1982 | Skinner et al. |
| 4,560,168 | A | 12/1985 | Aoyama |
| 4,679,795 | A | 7/1987 | Melvin et al. |
| 4,798,386 | A | 1/1989 | Berard |
| 4,804,189 | A | 2/1989 | Gobush |
| 4,921,759 | A | 5/1990 | Orain et al. |
| 4,925,193 | A | 5/1990 | Melvin et al. |
| 4,950,696 | A | 8/1990 | Palazotto et al. |
| 4,960,281 | A | 10/1990 | Aoyama |
| 4,985,340 | A | 1/1991 | Palazzotto et al. |
| 4,991,852 | A | 2/1991 | Pattison |

(Continued)

FOREIGN PATENT DOCUMENTS

| | | |
|---|---|---|
| JP | 2001-087423 | 4/2001 |

OTHER PUBLICATIONS

Mark S. Murphy; "Just Different Enough" Golf World Business; Apr. 8, 2005; p. 2.

(Continued)

*Primary Examiner* — Raeann Gorden
(74) *Attorney, Agent, or Firm* — Daniel W. Sullivan

(57) ABSTRACT

A golf ball having at least a core and a composite layer comprising a fibrous material and a matrix material is disclosed. The fibrous material may comprise a polymer, glass or metal. The matrix material preferably comprises a translucent polymer. In one embodiment of the present invention, the fibrous material comprises a ferromagnetic material and the golf ball is subjected to induction heating to improve adhesion between adjacent ball layers. The golf ball may additionally comprise a translucent cover layer surrounding the composite layer or an intermediate layer disposed between the composite layer and the core.

10 Claims, 4 Drawing Sheets

U.S. PATENT DOCUMENTS

| | | | | |
|---|---|---|---|---|
| 4,998,734 | A | 3/1991 | Meyer | |
| 5,000,458 | A | 3/1991 | Proudfit | |
| 5,018,742 | A | 5/1991 | Isaac et al. | |
| 5,143,377 | A | 9/1992 | Oka et al. | |
| 5,147,900 | A | 9/1992 | Palazzotto et al. | |
| 5,156,405 | A | 10/1992 | Kitaoh et al. | |
| 5,249,804 | A | 10/1993 | Sanchez | |
| 5,256,170 | A | 10/1993 | Harmer et al. | |
| 5,326,621 | A | 7/1994 | Palazzotto et al. | |
| 5,334,673 | A | 8/1994 | Wu | |
| 5,360,462 | A | 11/1994 | Harmer et al. | |
| 5,376,428 | A | 12/1994 | Palazzotto et al. | |
| 5,427,378 | A | 6/1995 | Murphy | |
| 5,442,680 | A | 8/1995 | Schellinger et al. | |
| 5,484,870 | A | 1/1996 | Wu | |
| 5,494,291 | A | 2/1996 | Kennedy | |
| 5,562,552 | A | 10/1996 | Thurman | |
| 5,575,477 | A | 11/1996 | Hwang | |
| 5,605,761 | A | 2/1997 | Burns et al. | |
| 5,672,643 | A | 9/1997 | Burns et al. | |
| 5,674,622 | A | 10/1997 | Burns et al. | |
| 5,688,191 | A | 11/1997 | Cavallaro et al. | |
| 5,692,974 | A | 12/1997 | Wu et al. | |
| 5,713,801 | A | 2/1998 | Aoyama | |
| 5,783,293 | A | 7/1998 | Lammi | |
| 5,800,286 | A | 9/1998 | Kakiuchi et al. | |
| 5,803,831 | A | 9/1998 | Sullivan et al. | |
| 5,820,488 | A | 10/1998 | Sullivan et al. | |
| 5,823,890 | A | 10/1998 | Maruko et al. | |
| 5,823,891 | A | 10/1998 | Winskowicz | |
| 5,840,788 | A | 11/1998 | Lutz et al. | |
| 5,885,172 | A | 3/1999 | Hebert et al. | |
| 5,900,439 | A | 5/1999 | Prissok et al. | |
| 5,902,191 | A | 5/1999 | Masutani et al. | |
| 5,919,100 | A | 7/1999 | Boehm et al. | |
| 5,929,189 | A | 7/1999 | Ichikawa et al. | |
| 5,938,544 | A | 8/1999 | Winskowicz | |
| 5,957,786 | A | 9/1999 | Aoyama | |
| 5,957,787 | A | 9/1999 | Hwang | |
| 5,965,669 | A | 10/1999 | Cavallaro et al. | |
| 5,981,654 | A | 11/1999 | Rajagopalan | |
| 5,981,658 | A | 11/1999 | Rajagopalan | |
| 5,989,135 | A | 11/1999 | Welch | |
| 5,993,968 | A | 11/1999 | Umezawa et al. | |
| 6,056,842 | A | 5/2000 | Dalton et al. | |
| 6,083,119 | A | 7/2000 | Sullivan et al. | |
| 6,120,394 | A | 9/2000 | Kametani | |
| 6,149,535 | A | 11/2000 | Bissonnette et al. | |
| 6,152,834 | A | 11/2000 | Sullivan | |
| 6,200,232 | B1 | 3/2001 | Kasashima et al. | |
| 6,207,784 | B1 | 3/2001 | Rajagopalan | |
| 6,251,991 | B1 | 6/2001 | Takesue et al. | |
| 6,277,037 | B1 | 8/2001 | Winskowicz et al. | |
| 6,358,160 | B1 | 3/2002 | Winskowicz | |
| 6,369,125 | B1 | 4/2002 | Nesbitt | |
| 6,450,902 | B1 | 9/2002 | Hwang | |
| 6,548,618 | B2 | 4/2003 | Sullivan et al. | |
| 6,558,227 | B1 | 5/2003 | Kodaira et al. | |
| 6,565,455 | B2 | 5/2003 | Hayashi | |
| 6,565,456 | B2 | 5/2003 | Hayashi | |
| 6,790,149 | B2 | 9/2004 | Kennedy et al. | |
| 6,824,476 | B2 | 11/2004 | Sullivan et al. | |
| 6,846,879 | B2 * | 1/2005 | Iwami | 525/179 |
| 6,872,154 | B2 | 3/2005 | Shannon et al. | |
| 6,949,595 | B2 | 9/2005 | Morgan et al. | |
| 7,090,798 | B2 | 8/2006 | Hebert et al. | |
| 7,291,076 | B2 | 11/2007 | Watabebe | |
| 2002/0045501 | A1 * | 4/2002 | Takemura et al. | 473/378 |
| 2002/0086743 | A1 | 7/2002 | Bulpett | |
| 2004/0176184 | A1 | 9/2004 | Morgan et al. | |
| 2004/0176185 | A1 | 9/2004 | Morgan et al. | |
| 2004/0176188 | A1 | 9/2004 | Morgan et al. | |
| 2005/0148409 | A1 | 7/2005 | Morgan et al. | |
| 2005/0197211 | A1 * | 9/2005 | Sullivan et al. | 473/371 |

OTHER PUBLICATIONS

Wilson Hope golf ball, http://www.pargolf.com/products/Wilson-Hope.htm, Jan. 27, 2005.
Color photographs of Volvik "Crystal" golf ball and packaging, 2005.
Volvik Crystal golf ball, http://www.volvik.co.kr/english/product/crystalasp, Jan. 21, 2005.
Volvik Golf Ball Brochure, 2005, pp. 1, 16-17 and 24.
Color photographs of Volvik "Crystal" golf ball, 2004.
Color photographs of Wilson "iWound", display model only with clear cover, 2001.
"Urea", Kirk-Othmer Encyclopedia of Chemical Technology. John Wiley & Sons, Inc. copyright 1998.
Color Photographs of Wilson "Quantum" golf ball, late 1990s.
Color Photographs of Pro Keds "Crystal π" golf ball, 1980's.
"Optical brightener" in Kirk-Othmer, Encyclopedia of Chemical Technology, 3d Edition, vol. 4, p. 213.

* cited by examiner

GOLF BALL WITH A TRANSLUCENT LAYER COMPRISING COMPOSITE MATERIAL

CROSS-REFERENCE TO RELATED APPLICATIONS

This application is a continuation-in-part of U.S. application Ser. No. 11/707,493, filed on Feb. 16, 2007, now U.S. Pat No. 7,722,483, which is incorporated by reference herein in its entirety.

FIELD OF THE INVENTION

The invention relates to golf balls, and more particularly, the invention is directed to golf balls with a translucent cover wherein visible fibrous elements are dispersed in the translucent cover, one or more intermediate layers, or both.

BACKGROUND OF THE INVENTION

Golf balls, whether of solid or wound construction, generally include a core and a cover. It is known in the art to modify the properties of a conventional solid ball by altering the typical single layer core and single cover layer construction to provide a ball having at least one mantle layer disposed between the cover and the core. The core may be solid or liquid-filled, and may be formed of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or, in many cases, be formed of a tensioned elastomeric winding, which are referred to as wound balls. The difference in play characteristics resulting from these different types of constructions can be quite significant. The playing characteristics of multi-layer balls, such as spin and compression, can be tailored by varying the properties of one or more of these intermediate and/or cover layers.

Another type of ball has evolved which employs a very large core and a very thin layer of elastic windings that forms a hoop-stress layer. In many golf balls, the ball diameter is about 1.68 inches. In such golf balls with a large core, the core has a diameter of between 1.50 and 1.63 inches. In such golf balls, the thickness of the thin wound layer is between 0.01 and 0.10 inches. In one example, the large core includes a center and a layer of conventional windings subsequently wound with threads that form a hoop-stress layer. The hoop-stress layer aids in rapidly returning the core to its spherical shape, and is a separate layer from the cover or core. The hoop-stress layer has about the same thickness as inner cover layers on many double-cover designs. Though most of the ball's resiliency comes from the core, the contribution of the wound hoop-stress layer to resiliency is significant.

Manufacturers generally provide the golf ball with a durable cover material, such as an ionomer resin, or a softer cover material, such as polyurethane or polyurea. Chemically, ionomer resins are a copolymer of an olefin and an $\alpha,\beta$-ethylenically-unsaturated carboxylic acid having 10-90 percent of the carboxylic acid groups neutralized by a metal ion and are distinguished by the type of metal ion, the amount of acid, and the degree of neutralization. Commercially available ionomer resins include copolymers of ethylene and methacrylic or acrylic acid neutralized with metal salts. Examples include SURLYN® from E.I. DuPont de Nemours and Co. of Wilmington, Del. and IOTEK® from Exxon Corporation of Houston, Tex.

Surrounding the core with an ionomeric cover material provides a very durable golf ball. This core/cover combination permits golfers to impart a high initial velocity to the ball that results in improved distance.

Polyurethanes are used in a wide variety of applications including adhesives, sealants, coatings, fibers, injection molding components, thermoplastic parts, elastomers, and both rigid and flexible foams. Polyurethane is the product of a reaction between a polyurethane prepolymer and a curing agent. The polyurethane prepolymer is generally formed by a reaction between a polyol and a diisocyanate. The curing agents are typically diamines or glycols. A catalyst is often employed to promote the reaction between the curing agent and the polyurethane prepolymer.

Since about 1960, various companies have investigated the usefulness of polyurethane as a golf ball cover material. U.S. Pat. No. 4,123,061 teaches a golf ball made from a polyurethane prepolymer of polyether and a curing agent, such as a trifunctional polyol, a tetrafunctional polyol, or a fast-reacting diamine. U.S. Pat. No. 5,334,673 discloses the use of two categories of polyurethane available on the market, i.e., thermoset and thermoplastic polyurethanes, for forming golf ball covers and, in particular, thermoset polyurethane covered golf balls made from a composition of polyurethane prepolymer and a slow-reacting amine curing agent, and/or a difunctional glycol.

Polyurea covers are formed from a polyurea prepolymer, which typically includes at least one diisocyanate and at least one polyether amine, and a curing agent, which can be hydroxy-terminated curing agents, amine-terminated curing agents and combinations thereof.

Additionally, U.S. Pat. No. 3,989,568 discloses a three-component system employing either one or two polyurethane prepolymers and one or two polyol or fast-reacting diamine curing agents. The reactants chosen for the system must have different rates of reactions within two or more competing reactions.

The color instability caused by both thermo-oxidative degradation and photodegradation typically results in a "yellowing" or "browning" of the polyurethane layer, an undesirable characteristic for urethane compositions are to be used in the covers of golf balls, which are generally white.

U.S. Pat. No. 5,692,974 to Wu et al. discloses golf balls which have covers and cores and which incorporate urethane ionomers. The polyurethane golf ball cover has improved resiliency and initial velocity through the addition of an alkylating agent such as t-butyl chloride to induce ionic interactions in the polyurethane and thereby produce cationic type ionomers. UV stabilizers, antioxidants, and light stabilizers may be added to the cover composition.

U.S. Pat. No. 5,484,870 to Wu discloses a golf ball cover comprised of a polyurea. Polyureas are formed from reacting a diisocyanate with an amine.

U.S. Pat. No. 5,823,890 to Maruko et al., discloses a golf ball formed of a cover of an inner and outer cover layer compression molded over a core. The inner and outer cover layers should have a color difference AE in Lab color space of up to 3.

U.S. Pat. No. 5,840,788 to Lutz et al. discloses a UV light resistant, visibly transparent, urethane golf ball topcoat composition for use with UV curable inks. The topcoat includes an optical brightener that absorbs at least some UV light at wavelengths greater than about 350 nm, and emits visible light, and a stabilizer package. The light stabilizer package includes at least one UV light absorber and, optionally, at least one light stabilizer, such as a HALS.

U.S. Pat. No. 5,494,291 to Kennedy discloses a golf ball having a fluorescent cover and a UV light blocking, visibly transparent topcoat. The cover contains a fluorescent material that absorbs at least some UV light at wavelengths greater than 320 nm and emits visible light.

Colored golf balls have been produced for many years. In the 1960s Spalding produced a yellow range ball with a blended cover that included polyurethane.

U.S. Pat. No. 4,798,386, to Berard, makes reference to white cores and clear covers and even locating decoration on the core to be visible through the clear cover. The Berard concept requires a core which has a satisfactory hue to achieve the desired finished ball coloration. A polybutadiene rubber core of such a color has never been produced and as such, clear cover 2-pc ball have had limited market success.

U.S. Pat. No. 4,998,734 to Meyer, describes a golf ball with a core, a clear cover and "layer interdisposed therebetween." However, the intermediate layer described is a thin layer of paper or plastic material whose purpose is only to bear textural, alphanumeric or graphical indicia. Meyer teaches that the layer should be sufficiently thin to permit substantial transference of impact forces from the cover to the core without substantially reducing the force.

The Pro Keds "Crystal π" golf ball appeared in the Japanese market. It had a white core bearing the ball markings and a clear Surlyn cover. This ball had a very thick clear cover (>0.065") and the surface dimple coverage was very low.

In the early 1990s, Acushnet made clear Surlyn cover, two-piece Pinnacle Practice balls. The covers were 0.050" thick.

A prototype Wilson Surlyn covered two-piece ball, "Quantum", of a design similar to the Pro Keds ball was found in the US in the late 1990s. The cover was greater than 0.065 inches thick.

U.S. Pat. No. 5,442,680, Proudfit is directed to a golf ball with a clear ionomer cover. The patent requires a blend of ionomers with different cations.

In the early 1990s a solid one-piece urethane golf ball having a hole for the insertion of a chemi-luminescent tube was sold as a "Night Golf" ball. It was relatively translucent to create the glow, but it was far from having the performance characteristics of standard golf balls.

Two-piece balls have been sold under the tradename "Glow Owl" which utilize a white core and a cover with glow in the dark materials. This ball is believed to embody the technology described in U.S. Pat. No. 5,989,135 to Welch, which describes a "partially translucent" cover.

At the January 2001 PGA Show, Wilson displayed samples of "iWound" golf balls with clear covers. They were not balls for actual play but mock-ups used to display their new "lattice wound" technology. The lattice (discontinuous inner cover layer) was Hytrel and the Surlyn outer cover layer was clear. Both the Hytrel lattice and red core were visible through the clear cover. No markings were on the core or lattice.

U.S. Pat. No. 5,713,801 to Aoyama discloses a golf ball comprising an opaque cover, a core and a thin layer of elastic windings surrounding the core that forms a hoop-stress layer.

Commonly-owned U.S. Pat. No. 6,899,642, which is incorporated herein by reference in its entirety, discloses a golf ball comprising at least a core and an opaque cover, said cover comprising a matrix material and fibrous elements that act as a hoop-stress layer.

To date, it has been difficult to properly attain the desired long-term appearance of golf ball covers without adversely affecting golf ball performance. Many golf balls have at least one layer of "paint" covering the cover material, however paint has been shown to chip or otherwise become damaged during routine play. Hence, there is a need in the art for golf balls having a unique appearance and optimal performance characteristics.

SUMMARY OF THE INVENTION

The present invention is directed to golf balls having a core and at least one composite layer comprising visible fibrous elements, which may be randomly dispersed therein or ordered in an array. The fibrous elements may result in better golf ball properties including, but not limited to, improved resiliency, decreased moisture vapor transmission rate, and improved adhesion between adjacent ball layers. The composite layer is preferably translucent, so that the fibrous elements are visible to the golfers.

According to one embodiment of the present invention, a golf ball comprises at least a core and a composite layer surrounding the core, wherein said composite layer comprises fibers or flakes with high aspect ratios and a matrix material. The matrix material preferably comprises translucent thermoplastic or thermoset polymers, such as polyurethane, polyurea, and ionomer resins, which allow the consumer to view the filament material embedded within.

The fibrous material may comprise polymers, glass, or metals, including shape memory alloys (SMAs) and ferromagnetic materials. In one embodiment of invention, a golf ball comprising a composite layer including a polymeric matrix material and ferromagnetic filament materials is subjected to induction heating (IH) to increase adhesion between the composite layer and other layers and/or the core.

The core of the golf ball of the present invention may be a solid single-piece core or a dual-core. A solid single-piece core preferably comprises a resilient polymer. A dual-core may further comprise a solid or wound layer and a fluid-filled center.

The golf ball of the present invention may further comprise an outer cover layer surrounding the composite layer. The outer cover layer preferably comprises a translucent polymer. The golf ball may also include an intermediate layer disposed between the composite cover layer and the core. The intermediate layer may comprise a polymeric material or may comprise elastic fibers wound around the core to form a hoop-stress layer.

DETAILED DESCRIPTION

Figure 1A:
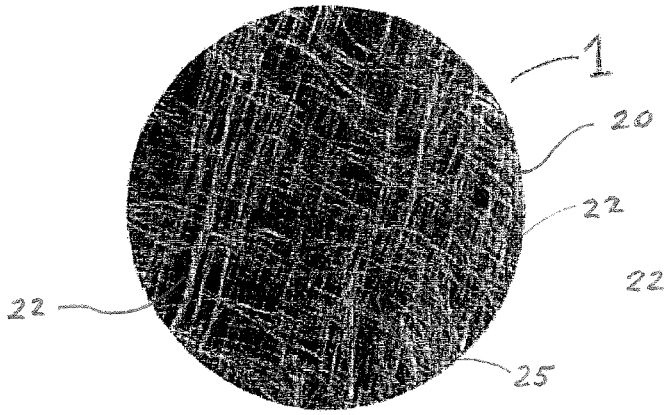
FIG. 1*a* is a plan view of a golf ball having a cover comprising a translucent polymeric matrix and a plurality of fibers embedded therewithin.

This invention is primarily directed to golf balls having a core and at least one layer comprising visible fibrous elements, which include high aspect ratio fibers or filament that may be randomly dispersed therein or ordered in a translucent binder or matrix. The fibrous elements may also contain high aspect ratio flakes to create a unique visual effect. The visible fibrous elements and flakes may be present within, or beneath, a transparent or translucent cover layer. Visible fibrous elements and flakes may be disposed within, beneath or above any subsurface layer, e.g., a vapor transmission resistance layer, a high modulus layer, a hoop stress layer, an intermediate layer or an outer core layer. The cover may comprise a polymeric matrix material molded around fibrous elements, filaments or flakes. The core layer may be a single-piece or dual-core. A dual-core may comprise solid or wound layers, and may have an inner core comprising a fluid, i.e., a gas or liquid.

The incorporation of a transparent or translucent material into the construction of the golf ball enables direct consumer observation of technological features embedded within, or present beneath, the transparent or translucent layer. Additionally, the fibrous elements or particulate materials present within or beneath the translucent or transparent cover layer, or above the opaque surface of the core or intermediate layer but below the translucent or transparent cover layer provide the aesthetic features of the golf ball. The visible fibrous elements may result in better golf ball properties including, but not limited to, improved resiliency, decreased moisture vapor transmission rate, and improved adhesion between adjacent ball layers.

F*igs*. 1*a-g* show golf balls (1-7) according to various embodiments of the present invention. The golf balls (1-7) pictured in F*igs*. 1*a-g* comprise a translucent cover layer (20) and a fibrous material (22) either fully or partially embedded within the polymeric matrix of the translucent cover (20). The fibrous material (22) may be in the faini of individual, randomly dispersed fibers, mats of woven, non-woven, stitch-bonded non-woven or knitted fibers, ordered metal fibers or wound filaments. The translucent cover (20) allows golfers to visualize the fibrous elements (22) included in the golf ball and a number of other internal elements, such as the surfaces of intermediate or core layers (25). The visible fibers (22) and internal structure provide for a distinct and pleasing aesthetic effect.

A "translucent" matrix material preferably has an average transmittance of visible light (e.g., between about 380 nm and about 770 nm or alternately between about 400 nm and about 700 nm) of at least about 10 percent, preferably at least about 20 percent, more preferably at least about 30 percent. The average transmittance referred to herein is typically measured for incident light normal (i.e., at approximately 90°) to the plane of the object and can be measured using any known light transmission apparatus and method, e.g., a UV-Vis spectrophotometer.

A "transparent" matrix material preferably has an average transmittance of visible light (e.g., between about 380 nm and about 770 nm or alternately between about 400 nm and about 700 nm) of at least about 40 percent, preferably at least about 60 percent, more preferably at least about 80 percent. As used herein, the term "transparent" is included in the term "translucent."

Suitable materials for fibrous elements, i.e., fibers or filament, present within, or beneath, a transparent or translucent cover layer are discussed in commonly-owned U.S. Pat. No. 6,899,642, which is incorporated herein by reference in its entirety. The fibrous elements may comprise polymers including but not limited to polyether urea such as LYCRA®, poly(ester-urea), polyester block copolymers such as HYTREL®, poly(propylene), polyethylene, polyamide, acrylics, polyketone, poly(ethylene terephthalate) such as DACRON®, poly(phenylene terephthalate) such as KEVLAR®, poly(acrylonitrile) such as ORLON®, trans-diaminodicyclohexylmethane, dodecanedicarboxylic acid such as QUINA® and poly(trimethylene terephthalate) as disclosed in U.S. Pat. No. 6,232,400 to Harris et al. SURLYN®. LYCRA®, HYTREL®, DACRON®, KEVLAR®, ARAMID®, ORLON®, and QUINA® are available from E. I. DuPont de Nemours & Co. SPECTRA® from the Honeywell Co. can also be used.

Fibrous materials may comprise glass, such as S-GLASS® from Corning Corporation.

Fibrous materials may also comprise metal. Suitable metal fibers include shape memory alloys (SMA). Examples of SMA materials that can be used are Ag—Cd, Cu—Al—Ni, Cu—Sn, Cu—Zn, Cu-Z—X (X=Si, Sn, Al), In—Ti, Ni—Al, Ni—Ti, Fe—Pt, Mn—Cu, and Fe—Mn—Si, however the present invention is not limited to these particular SMA materials. The filament material can include at least some fibers formed of a SMA, can include fibers that are all SMA, can include fibers that include some or all non-shape memory alloy materials, or the filament material can include a blend of SMA fibers and non-SMA fibers. For example, the filament material can include a Ni—Ti SMA fiber along with non-SMA fiber, such as carbon/epoxy fiber, to provide enhanced tensile strength in comparison to composites with only non-SMA fiber.

Preferably, the tensile modulus of the fibrous material is greater than the tensile modulus of the binder or matrix material comprising the cover. More preferably, the fibrous material has a tensile modulus or Young's modulus greater than about 30,000 psi. As used herein, tensile modulus of the fibrous material is defined in accordance with the ASTM D-3379-75 for single fiber filament material. ASTM D-4018-81 may be used to measure the tensile modulus for multi-fiber tows. ASTM D-638-01 may be used to measure the tensile modulus or Young's modulus of the matrix material. In a golf ball comprising a composite cover, wherein the cover comprises a matrix material and the fibrous material discussed above, this preferred range of tensile modulus of the fibrous material allows the cover to function as a hoop-stress element. For instance, in a golf ball comprising a cover and a core, the composite cover prevents the core from becoming excessively deformed after being hit, and rapidly returns the core to its spherical shape. The fibrous material is selected such that it can sustain sufficient deformation at impact and remain elastic, i.e. essentially deforming with as little energy loss as possible. As a result, the composite cover layer contributes significantly to the resiliency of the ball.

Fibers embedded within or beneath a transparent or translucent layer are discrete pieces of fibrous material. To allow direct observation by the golfer, the fibers should have a length of at least about 0.5 mm. However the length of the fibers and fibrous elements of the present invention may vary as required to achieve a particular physical property, i.e., stiffness, or technological effect, i.e., moisture barrier, or simply to attain a desired aesthetic effect. In accordance with this aspect of the invention, individual fibers preferably have a length between about 0.5 mm and 10.0 mm. Fibers may be randomly dispersed beneath or within a translucent or transparent layer. FIG. 1*a* shows a golf ball according to this embodiment. Golf ball 1 comprises a translucent cover and plurality of fibers embedded therein. The fibers are randomly distributed throughout the cover and are easily viewed by a golfer due to the translucent nature of the polymeric matrix material comprising the cover.

Figure 1B:
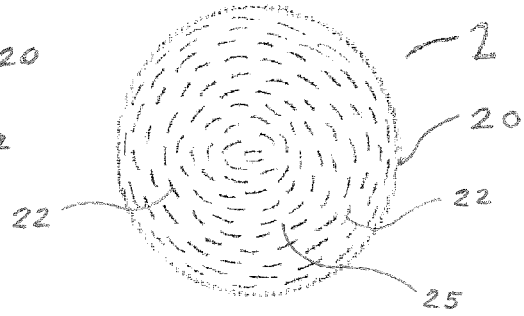
FIG. 1*b* is a plan view of a golf ball having a cover comprising a translucent polymeric matrix and a plurality of ordered fibers embedded therewithin.

Alternatively, fibers may be ordered in any array, as shown in FIG. 1*b*. In accordance with this aspect of the invention, golf ball 2 includes magnetized metal fibers or ferromagnetic fibers dispersed through an uncured or unset polymeric matrix material, injected around a core, and subjected to a magnetic field before curing or setting of the matrix material. Due to the magnetic field, the magnetized metal or ferromagnetic fibers can orient in a parallel or circular fashion.

Figure 1C:
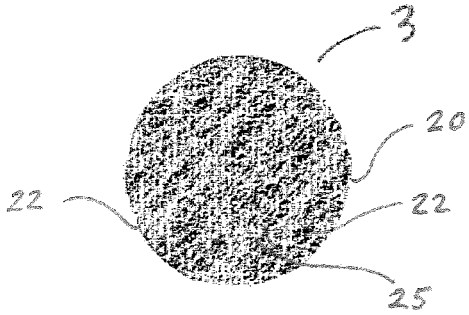
FIG. 1*c* is plan view of a golf ball having a cover comprising a translucent polymeric matrix and a mat of woven fibers at least partially embedded therewithin.
Figure 1D:
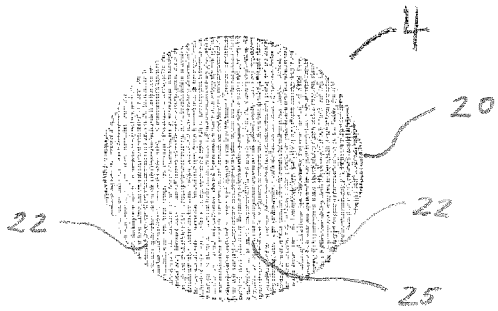
FIG. 1*d* is a plan view of a golf ball having a cover comprising a translucent polymeric matrix and a mat of non-woven stitch-bonded fibers at least partially embedded therewithin.
Figure 1E:
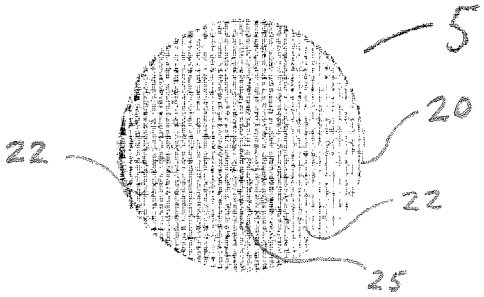
FIG. 1*e* is a plan view of a golf ball having a cover comprising a translucent polymeric matrix and a mat of woven fibers at least partially embedded therewithin.
Figure 1F:
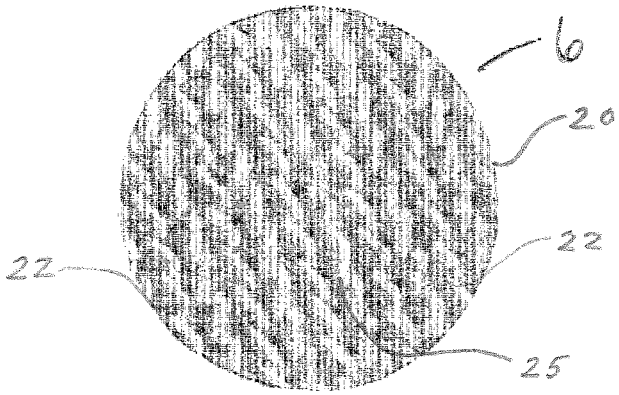
FIG. 1*f* is a plan view of a golf ball having a cover comprising a translucent polymeric matrix and a mat of knit fibers at least partially embedded therewithin.

A plurality of fibers may also form a mat, which may be woven, knit or non-woven. A single mat may be disposed around a core or intermediate layer. Non-woven mats can produce a visually pleasing effect as shown in FIG. 1*c*. Golf ball 3 comprises a translucent cover and a mat of non-woven fiber at least partially embedded in said cover. Non-woven mats can also be stitch-bonded for additional visual effects, as shown in golf ball 4 of FIG. 1*d*. As in FIG. 1*c*, the stitch-bonded mat of FIG. 1*d* may be fully or partially embedded in the matrix material comprising the cover. FIG. 1*e* shows golf ball 5 having a translucent cover and a woven mat at least partially embedded therein. Golf ball 6 of FIG. 1*f* also comprises a translucent cover a woven mat; however, the mat in this instance is knit. The knit fiber mat may be fully or partially embedded in the translucent cover.

In one embodiment two mats, each cut into the shape of a figure-eight, are joined together in the fashion of a tennis ball to form a layer. Alternatively, one figure-eight fiber mat and one translucent or opaque figure-eight may be joined.

Figure 1G:
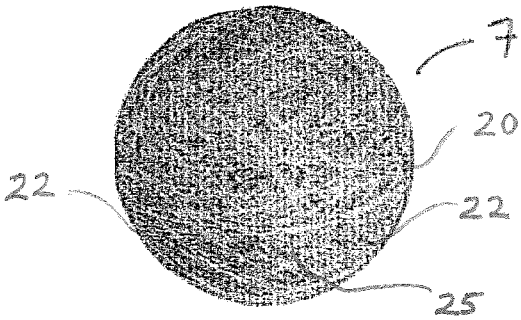
FIG. 1*g* is a plan view of a golf ball having a cover comprising a translucent polymeric matrix and a wound filament at least partially embedded therewithin.
Figure 2A:
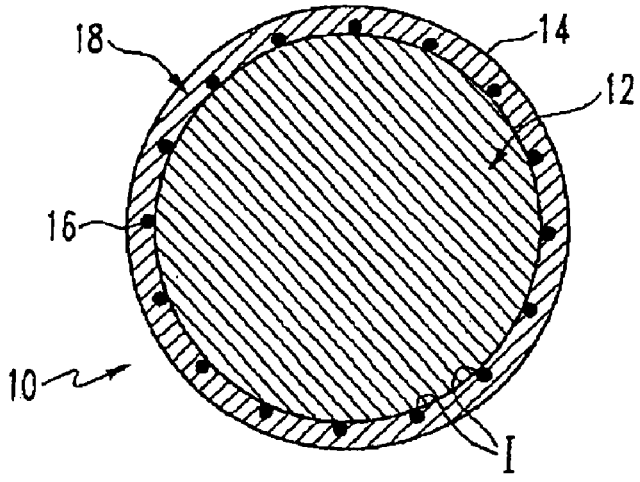
FIG. 2*a* is a cross-sectional view a golf ball having a core and a cover comprising a translucent matrix and a fibrous material.

A cross-sectional view of a golf ball according to this aspect of the invention is also shown in FIG. 2*a*. Golf ball 10 includes a core 12 surrounded by at least one transparent or translucent cover layer 14 formed of a composite material. The composite material forming the cover layer 14 includes fibers 16 embedded in a matrix material 18 as shown. In accordance with this embodiment, and as shown in FIG. 1, fibers 16 contact the surface of core 12 at interface I. As fibers 16 are at least partially embedded in matrix material 18, interface I is discontinuous. Fibers 16 may comprise polymers, glass, metal, or other materials discussed above as suitable fibrous material. Preferably, each fiber has an aspect ratio, defined by average fiber length over average fiber diameter, of about 5 or greater. Fibers 16 can also be embedded on the surface of core 12. For certain applications, e.g., the array of flakes shown in FIG. 1*b*, the spacings between fibers 16 are even. For non-woven mats, the spacings would be irregular. For woven or knit mats, interface I would be a connected layer.

Figure 2B:
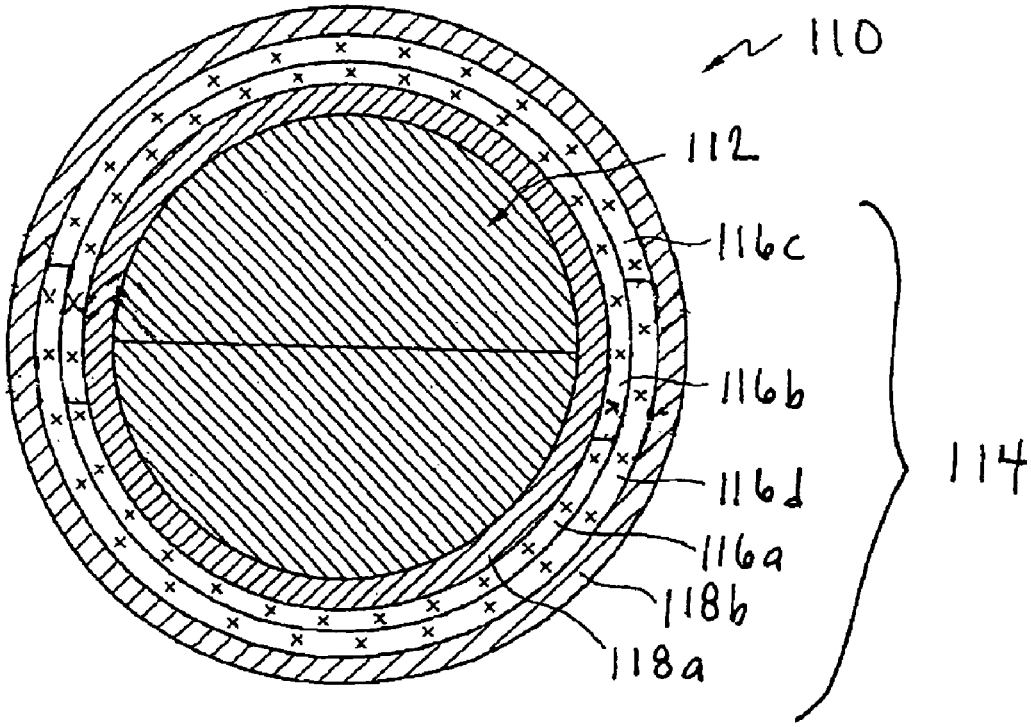
FIG. 2*b* is a cross-sectional view of a golf ball having a core and a cover comprising a translucent matrix and a plurality of fiber mats.

FIG. 2*b* shows a cross-sectional view of a golf ball including mats of woven or non-woven fibers. Golf ball 110 comprises core 112, fibers 116*a-d* and matrix material 118*a* and *b*. Fibers 116*a-d* form mats that may be woven or non-woven. In the case of woven mats, fibers 116*a-d* may be connected such that the fibers of each mat are interconnected by the weaving process. In the case of non-woven mats, fibers 116*a-d* may be connected such that bonding between the fibers of each mat interconnect the fibers of each mat. The fibers of one mat may be oriented in a first direction and fibers of the adjacent mat may be oriented in a second direction different from the first direction. The number and orientation of the mats can be varied with consideration to the properties and composition of the filament material and matrix material, and importantly to achieve desired ball properties. Matrix material 118*a* and *b* may be molded around fibers 116*a-d* so that the mats are embedded within the matrix material to form a single composite cover layer 114.

Figure 2C:
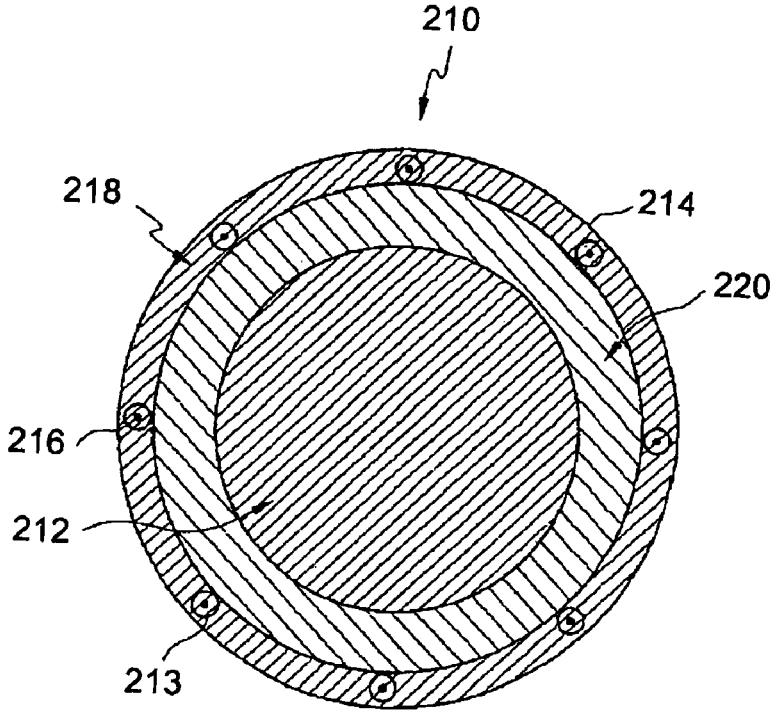
FIG. 2*c* is a cross-sectional view of a golf ball having a core, a cover comprising a translucent matrix and a fibrous material and an intermediate layer disposed between the core and the cover.

The fibrous material of the present invention may alternatively be a filament comprising a long length of fibrous material wound around a layer of the golf ball and either partially or fully embedded within a matrix material. The fibrous material may comprise a plurality of filaments, forming a multi-fiber bundle, wound around a layer of the golf ball. FIG. 1*g* shows golf ball 7, which includes a translucent cover and a layer of wound filament at least partially embedded in said cover. This embodiment of the present invention is also illustrated shown in FIG. 2*c*. Golf ball 210 comprises core 212, intermediate layer 220, and cover layer 214, comprising filament material 216 and matrix material 218. According to this embodiment, filament material 216 is preferably pre-coated with a matrix material prior to being wound around intermediate layer 220. Filament material 216 may comprise any of the fibrous materials discussed above and is preferably pre-coated with a translucent matrix material. The pre-winding matrix material 218, which is shown inside circle 213, need not be identical to the post-winding matrix material 218 that comprises the remaining portion of cover layer 214. Post-winding matrix material 218 may also comprise any of the translucent matrix materials previously discussed. As filament material 216 is substantially enveloped in pre-winding matrix material 218 and is embedded in post-winding matrix material 218, filament material 216 does not contact intermediate layer 220, and hence no interface exists. Filament material 216 preferably comprises many individual fibers or strands, and may be formed by such processes as melt spinning, wet spinning, dry spinning, or polymerization spinning.

Intermediate layer 220 may comprise materials such as polybutadiene, natural rubber, polyisoprene, styrene-butadiene, or ethylene-propylene-diene rubber or highly neutralized polymers. Intermediate layer 220 may alternatively comprise a matrix material. In another embodiment of the present invention, intermediate layer 220 comprises a layer of wound elastic fibers, forming a hoop-stress layer.

In accordance with this invention, wound filament material may be embedded within an intermediate layer, as opposed to a cover layer. In this case, the intermediate layer preferably comprises a translucent matrix material, further discussed below.

In accordance with another embodiment of the present invention, a golf ball may comprise at least a core and a cover layer and fibrous material comprising a metal or metals susceptible to induction heating (1H). Commonly-owned U.S. Patent Application Publication No. 2006/0148590 teaches a golf ball comprising metal materials heated through induction heating and is incorporated herein by reference in its entirety. Induction heating of the metal filament material can improve adhesion between layers comprising the metal filament material and adjacent layers. The process of IH includes applying an alternating current (AC) to an induction coil to generate a magnetic field, and supplying a work piece around which the magnetic field works. The work piece in this instance is the golf ball comprising fibrous material comprising metals sensitive to the magnetic field. Metal filament materials sensitive to magnetic fields resist the rapidly changing magnetic fields produced by AC within the induction coil, resulting in friction which produces heat known as hysteresis heating.

Figure 2D:
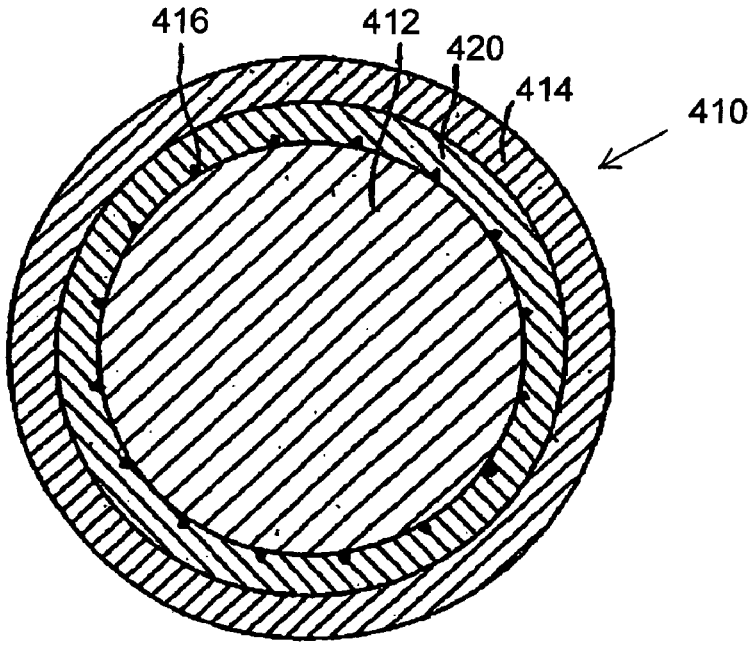
FIG. 2*d* is a cross-sectional view of a golf ball having a core, a cover layer and an intermediate layer comprising a polymeric material and a ferromagnetic fibrous material.

FIG. 1*b* provides a plan view of a golf ball according this aspect of the invention. Golf ball 2 has a translucent cover comprising a polymeric matrix material a plurality of ferromagnetic fibers at least partially embedded therein. FIG. 2*d* shows a cross-sectional view of a golf ball in accordance with this embodiment. Golf ball 410 comprises core 412 and cover layer 414 and intermediate layer 420. Intermediate layer 420 further comprises metal filament material 416. Preferably, metal filament material 416 comprises ferromagnetic materials (FMMs) such as iron, nickel or cobalt, as they exhibit a strong attraction to magnetic fields and hence are easy to heat via IH. Intermediate layer 420 may comprise a translucent thermoset material such as polyurethane or polyurea. Cover layer 414 preferably comprises a translucent matrix material. Ferromagnetic filament material 416 is preferably at least partially embedded within intermediate layer 420. Induction heating of ferromagnetic filament material 416 can help to cure the thermoset material and improve adhesion between thermoset intermediate layer 420 and core 412 and cover layer 414.

In an alternative embodiment, cover layer 414 can comprise a thermoset material while intermediate layer 420 may comprise a composite layer including ferromagnetic filament material 416. Induction heating of ferromagnetic filament material 416 provides heat to indirectly cure thermoset cover layer 414, again improving adhesion between cover layer 414 and intermediate layer 420. Ferromagnetic filament material 416 may alternatively be embedded in cover layer 414.

Ferromagnetic filament material 416 is preferably a continuous filament wound or wrapped around core 412 and at least partially embedded in polymeric matrix material comprising intermediate layer 420. Examples of suitable FMMs include, but are not limited to, $CO_2Ba_2Fe_{12}O_{22}$, $Fe_3O_4$ (44 micron), $Fe_3O_4$ (840 micron), $Fe_2O_3$, $SrFe_{12}O_{19}$, iron, cobalt, nickel, the rare earth elements including lanthanum, cerium, praseodymium, neodymium, promethium, samarium, europium, gadolinium, terbium, dysprosium, holmium, erbium, thulium, ytterbium, and lutetium, the actinide elements including actinium, thorium, protactinium, uranium, neptunium, plutonium, americium, curium, berkelium, californium, einsteinium, fermium, mendelevium, nobelium, lawrencium, iron containing compounds such as iron based steel stocks, e.g. S45C and S55C, and pre-hardened steel stocks, e.g. NAK steel.

In another aspect of the invention, intermediate layer 420 acts as a moisture barrier layer. Ferromagnetic filament material 416 undergoes IH to improve adhesion between layers 420, 414 and 412. Intermediate layer 420 is preferably applied as a spray, dip or spin in a very thin coating applied over ferromagnetic filament material 416 in order to improve adhesion and prevent the penetration of moisture into golf ball 410.

According to another aspect of the invention, a golf ball may also comprise at least a cover, a core, and an intermediate layer comprising a metal mesh. The metal mesh may be formed around the core similar to the application of the cover of a tennis ball. Two metal mesh elements in the shape of a "figure eight" may be joined to form the intermediate layer. The cover of the golf ball is preferably a matrix material and may be molded around the intermediate metal mesh layer so that the metal mesh is at least partially embedded within the matrix material.

The core of the present invention may comprise a polymer such as ionomeric copolymers and terpolymers, thermoset materials, ionomer precursors, thermoplastics, thermoplastic elastomers, polybutadiene rubber, balata, grafted metallocene-catalyzed polymers, single-site polymers, high-crystalline acid polymers, cationic ionomers, and mixtures thereof. The core may be colored or may be transparent or translucent. As used herein, and as discussed in commonly-owned U.S. Patent Publication No. 2007/0149323, previously incorporated by reference, the term "core" refers to any portion of the golf ball surrounded by the cover. In the case of a golf ball comprising three layers, the core is the portion including at least the inner-most center layer and the intermediate layer, also referred to as the outer core layer, immediately surrounding the center. In accordance with the present invention, the intermediate or outer core layer may comprise a solid polymeric material or may be a layer of wound elastomeric material. An intermediate or outer core layer comprising a solid polymeric material may be colored or may be transparent or translucent.

A golf ball having a core comprising two layers may be referred to as a "dual-core" or a "multi-piece core." A golf ball of the present invention may also comprise a multi-piece core having more than two layers. The center of a dual-core or multi-piece core may comprise a solid material or a fluid, i.e., a gas or liquid. The center may alternatively comprise a semi-solid such as a paste or gel.

According to the desired performance parameters of the golf ball, the fluid-filled center of the core may comprise a gas, such as nitrogen, air, or argon; or a liquid, such as saline solution, corn syrup, saline solution and corn syrup, glycol in water, or oils. Other appropriate liquids for filling fluid-filled center include water soluble or dispersable organic compounds, pastes, colloidal suspensions, such as clay, barytes, carbon black in water or another liquid, or salt in water/glycol mixtures. The fluid-filled center may also comprise gels, such as water gelatin gels, hydrogels, water/methyl cellulose gels and gels comprised of copolymer rubber-based materials such as styrene-butadiene-styrene rubber and paraffinic and/or naphthionic oil. The fluid-filled center may also comprise melts, including waxes and hot melts (materials which are solid at or about room temperature but which become liquid at temperatures above room-temperature).

The cover or intermediate layers of the present invention preferably comprise a binder or matrix material comprising a clear or translucent material and may be molded using any technique known in the art, such as injection molding, reaction injection molding, compression molding, or casting, depending on the material selected. Suitable matrix materials include, but are not limited to, thermoplastic, thermoset materials, polyurethane, polyurea, and ionomer resins. Examples of ionomer resins include SURLYN® from E. I. DuPont de Nemours and Co. of Wilmington, Del. and IOTEK® from Exxon Corporation of Houston, Tex.

Polyurethane that is useful in the present invention includes the reaction product of polyisocyanate, at least one polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), m-phenylene diisocyanate ("MPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate ("TMDI"), tetracene diisocyanate, napthalene diisocyanate, anthracene diisocyanate, and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1 percent to about 0.5 percent free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14 percent unreacted NCO groups. Preferably, the at least one polyisocyanate has less than about 7.9 percent NCO, more preferably, between about 2.5 percent and about 7.8 percent, and most preferably, between about 4 percent to about 6.5 percent.

Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

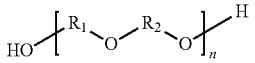

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

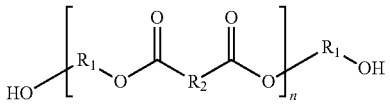

where $R_1$ and $R_2$ are straight or branched hydrocarbon chains, each containing from 1 to about 20 carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups. In another embodiment, polycaprolactone polyols are included in the materials of the invention.

Preferably, any polycaprolactone polyols have the generic structure:

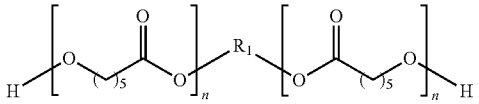

where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

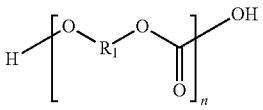

where $R_1$ is predominantly bisphenol A units -(p-$C_6H_4$)—C($CH_3$)$_2$-(p-$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000. Polyamine curatives are also suitable for use in the polyurethane composition of the invention and have been found to improve cut, shear, and impact resistance of the resultant balls. Preferred polyamine curatives have the general formula:

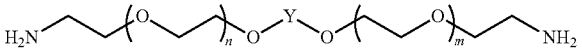

where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (trade name ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyl-diamino diphenyl methane; para, para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the following general chemical structure:

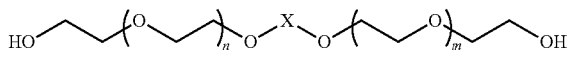

where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy)ethoxy] benzene, and 1,3-bis-{2-[2-(2-hydroxyethoxy)ethoxy] ethoxy} benzene; 1,4-butanediol; resorcinol-di-(β-hydroxyethyl)ether; and hydroquinone-di-(β-hydroxyethyl) ether; and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art. Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

The cover may alternatively comprise polyurea. In one embodiment, the polyurea prepolymer includes at least one diisocyanate and at least one polyether amine.

In this aspect of the invention the diisocyanate is preferably saturated, and can be selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. The saturated diisocyanate is preferably selected from the group consisting of isophoronediisocyanate, 4,4'-dicyclohexylmethane diisocyanate, 1,6-hexamethylene diisocyanate, or a combination thereof. In another embodiment, the diisocyanate is an aromatic aliphatic isocyanate selected from the group consisting of meta-tetramethylxylene diisocyanate; para-tetramethylxylene diisocyanate; trimerized isocyanurate of polyisocyanate; dimerized uredione of polyisocyanate; modified polyisocyanate; and mixtures thereof.

The polyether amine may be selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof. In one embodiment, the polyether amine has a molecular weight of about 1000 to about 3000.

The curing agent may be selected from the group consisting of hydroxy-terminated curing agents, amine-terminated curing agents, and mixtures thereof, and preferably has a molecular weight from about 250 to about 4000.

In one embodiment, the hydroxy-terminated curing agents are selected from the group consisting of ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy)ethoxy]cyclohexane; 1,3-bis-{2-[2-(2-hydroxyethoxy)ethoxy]ethoxy}cyclohexane; trimethylolpropane; polytetramethylene ether glycol, preferably having a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis- (sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

In one embodiment, the composition further includes a catalyst that can be selected from the group consisting of a bismuth catalyst, zinc octoate, di-butyltin dilaurate, di-butyltin diacetate, tin (II) chloride, tin (IV) chloride, di-butyltin dimethoxide, dimethyl-bis[1-oxonedecyl)oxy]stannane, di-n-octyltin bis-isooctyl mercaptoacetate, triethylenediamine, triethylamine, tributylamine, oleic acid, acetic acid; delayed catalysts, and mixtures thereof. The catalyst may be present from about 0.005 percent to about 1 percent by weight of the composition.

Any method available to one of ordinary skill in the art may be used to combine the polyisocyanate, polyol or polyamine, and curing agent of the present invention. One commonly employed method, known in the art as a one-shot method, involves concurrent mixing of the polyisocyanate, polyol or polyether amine, and curing agent. This method results in a mixture that is inhomogenous (more random) and affords the manufacturer less control over the molecular structure of the resultant composition. A preferred method of mixing is known as the prepolymer method. In this method, the polyisocyanate and the polyol or polyether amine are mixed separately prior to addition of the curing agent. This method seems to afford a more homogeneous mixture resulting in a more consistent polymer composition.

The matrix material may also comprise ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The ionomeric material may acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. The ionomer may include so-called "low acid" and "high acid" ionomers, as well as blends thereof. In general, ionic copolymers including up to about 15 percent acid are considered "low acid" ionomers, while those including greater than about 15 percent acid are considered "high acid" ionomers.

"Low acid" ionomers may be combined with a softening comonomer such as vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, and butyl methacrylate, and are believed to impart high spin to golf balls.

Covers comprising "high acid" ionomers are believe to impart low spin and longer distance to golf balls. A cover of the present invention may comprise about 15 to about 35 weight percent acrylic or methacrylic acid, making the ionomer a high modulus ionomer. An additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

The translucent binder or matrix material may additionally comprise pigment or dye in an amount sufficient to provide a hue to the material but maintain translucence. Suitable dyes include fluorescent dyes such as from the thioxanthene, xanthene, perylene, perylene imide, coumarin, thioindigoid, naphthalimide and methine dye classes. Useful dye classes have been more completely described in U.S. Pat. No. 5,674,622, which is incorporated herein by reference in its entirety. Representative yellow fluorescent dye examples include, but are not limited to: Lumogen F Orange™240 (BASF, Rensselaer, N.Y.); Lumogen F Yellow™083 (BASF, Rensselaer, N.Y.); Hostasol Yellow™3G (Hoechst-Celanese, Somerville, N.J.); Oraset Yellow™8GF (Ciba-Geigy, Hawthorne, N.Y.); Fluorol 088™ (BASF, Rensselaer, N.Y.); Thermoplast F Yellow™084 (BASF, Rensselaer, N.Y.); Golden Yellow™D-304 (DayGlo, Cleveland, Ohio); Mohawk Yellow™D-299 (DayGlo, Cleveland, Ohio); Potomac Yellow™D-838 (DayGlo, Cleveland, Ohio) and Polyfast Brilliant Red™SB (Keystone, Chicago, Ill.).

The binder or matrix materials described above may also comprise reflective, pearlescent or iridescent particulate materials. The cover may contain reflective or optically active particulates such as described by Murphy in U.S. Pat. No. 5,427,378 which is incorporated herein by reference. Pearlescent pigments sold by the Mearle Corporation can also be used in this way. The reflective particulates preferably have an aspect ratio of about 5 or greater and may comprise at least one member selected from the group consisting of metal flake, iridescent glitter, metalized film and colored polyester foil.

In another embodiment of the invention, the cover may be cast or compression molded. This process involves the joining of two cover hemispheres at an equator. As such, the cover may comprise one hemisphere comprising a transparent or translucent cover comprising the materials discussed above and one conventional opaque or white hemisphere. Additionally, other inventive aspects of the present invention, such as a cover comprising fibers or filaments, woven or non-woven fibrous mats, ferromagnetic filaments, high aspect ratio reflective particulates or metal mesh may be incorporated into only one hemisphere of the golf ball cover.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball comprising an opaque core and a composite cover layer and an inteiniediate layer disposed between the core and the composite layer and an outer cover layer surrounding the composite cover layer, the outer cover layer comprising a translucent polymer;

wherein at least a portion of said composite cover layer comprises a translucent polymer, and wherein a fibrous material is at least partially embedded in said translucent polymer of said composite cover layer so the fibrous material is visible to a person viewing the ball, and wherein said fibrous material comprises at least one material selected from the group consisting of polymers, ceramic glass, and metal.

2. The golf ball of claim 1, wherein said fibrous material comprises individual fibers having a length between about 0.5 mm and about 10.0 mm.

3. The golf ball of claim 1, wherein said fibrous material comprises a filament.

4. The golf ball of claim 1, wherein said fibrous material has an aspect ratio of about 5 or greater.

5. The golf ball of claim 1, wherein said fibrous material comprises at least one material selected from the group consisting of polyether urea, poly(ester-urea), polyester block copolymers, poly(propylene), polyethylene, polyamide, acrylics, polyketone, poly(ethylene terephthalate), poly(phenylene terephthalate), poly(acrylonitrile), trans-diaminodicyclohexylmethane, dodecanedicarboxylic acid and poly(trimethylene terephthalate).

6. The golf ball of claim 1, wherein said intermediate layer comprises at least one polymer.

7. The golf ball of claim 6, wherein said polymer is selected from the group consisting of polybutadiene, natural rubber, polyisoprene, styrene-butadiene, ethylene- propylene-diene rubber and highly neutralized polymers.

8. The golf ball of claim 1, wherein said intermediate layer comprises elastic fibers wound around said core.

9. The golf ball of claim 1, wherein said composite layer further comprises an amount of reflective particulates.

10. The golf ball of claim 9, wherein said reflective particulates have an aspect ratio of at least about 5 and are selected from the group consisting of metal flake, iridescent glitter, metalized film and colored polyester foil.

* * * * *